US006360928B1

(12) United States Patent
Russo

(10) Patent No.: US 6,360,928 B1
(45) Date of Patent: Mar. 26, 2002

(54) UNIVERSAL HOLDER DEVICE

(76) Inventor: Gerard Russo, 2509 Gardi St., Duarte, CA (US) 91010

( * ) Notice: Subject to any disclaimer, the term of this patent is extended or adjusted under 35 U.S.C. 154(b) by 0 days.

(21) Appl. No.: 09/704,442

(22) Filed: Nov. 1, 2000

(51) Int. Cl.[7] ..... A45F 3/14
(52) U.S. Cl. ..... 224/218; 224/901.4; 24/3.2
(58) Field of Search ..... 224/217, 218, 224/219, 221, 222, 901.4; 24/3.1, 3.2, 3.12

(56) References Cited

U.S. PATENT DOCUMENTS

| | | | | |
|---|---|---|---|---|
| 327,759 A | | 10/1885 | Boyle | |
| 956,534 A | | 5/1910 | Lahey | |
| 1,788,420 A | | 1/1931 | Blumberg | |
| 3,273,766 A | | 9/1966 | Cosentino | |
| 3,374,508 A | | 3/1968 | Slimovitz | |
| 3,550,824 A | | 12/1970 | Bohanski | |
| 3,942,194 A | * | 3/1976 | Winter | 224/219 X |
| 3,947,927 A | | 4/1976 | Rosenthal | |
| 4,083,481 A | | 4/1978 | Selinko | |
| 4,327,837 A | | 5/1982 | Ross | |
| D271,160 S | | 11/1983 | Sherwin | |
| 4,504,980 A | * | 3/1985 | Butcher | 224/218 X |
| 4,606,484 A | * | 8/1986 | Winter et al. | 224/218 |
| 4,958,758 A | | 9/1990 | Tipple et al. | |
| 5,309,328 A | * | 5/1994 | Lum | 224/219 X |
| 5,412,545 A | | 5/1995 | Rising | |
| 5,456,037 A | | 10/1995 | Dorval | |
| D391,075 S | | 2/1998 | Jackson et al. | |
| 5,727,290 A | | 3/1998 | Gilbert et al. | |
| 5,901,381 A | | 5/1999 | Nelson | |
| 5,957,515 A | * | 9/1999 | Van Der Sluys | 224/218 X |

* cited by examiner

*Primary Examiner*—Stephen K. Cronin
(74) *Attorney, Agent, or Firm*—Eric K. Karich

(57) ABSTRACT

A universal holder device for mounting a tool upon a user's hand has a hand attachment element and a tool attachment element. The hand attachment element includes an attachment post. The hand attachment element further includes a first attachment strap and a second attachment strap that cooperate to removably attach the hand attachment element to the user's hand. The tool attachment element has an adhesive layer for attaching the tool attachment element to the tool. The tool attachment element also includes a post receiving bore that is shaped to receive the attachment post to rotatably mount the tool upon the hand attachment element.

5 Claims, 3 Drawing Sheets

UNIVERSAL HOLDER DEVICE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to holding devices, and more particularly to a universal holder device that can be attached to a user's hand for holding a tool at a preferred angle adjacent the back of the user's hand.

2. Description of Related Art

Attaching useful tools to the left hand or wrist, positioned for easy use by the user's right hand, are well known in the prior art. The following art defines the present state of this field:

Boyle, U.S. Pat. No. 327,759, teaches a holder for tablets and pencils that attaches to the left arm so that the pad and pencil are always handy and cannot be misplaced. A similar pad holder is taught by Lahey, U.S. Pat. No. 956,534.

Cosetino, U.S. Pat. No. 3,273,766, teaches a wrist article retaining device for rotatably attaching a flashlight to the user's left wrist. Similar wrist retaining devices are taught by Bohanski, U.S. Pat. No. 3,550,824 and Dorval, U.S. Pat. No. 5,456,037.

Finally, similar devices adapted to hold items such as flashlights on the user's head are taught by Rising, U.S. Pat. No. 5,412,545, and Nelson, U.S. Pat. No. 5,901,381.

The prior art teaches various holding devices for flashlights, notepads, and the like. However, the prior art does not teach a universal holder device for adjustably holding a tool on the back of the user's hand. The present invention fulfills these needs and provides further related advantages as described in the following summary.

SUMMARY OF THE INVENTION

The present invention teaches certain benefits in construction and use which give rise to the objectives described below.

The present invention provides a universal holder device for mounting a tool upon a user's hand. The universal holder device includes a hand attachment element and a tool attachment element. The hand attachment element includes an attachment post. The hand attachment element further includes a first attachment strap and a second attachment strap that cooperate to removably attach the hand attachment element to the user's hand. The tool attachment element has an adhesive layer for attaching the tool attachment element to the tool. The tool attachment element also includes a post receiving bore that is shaped to receive the attachment post to rotatably mount the tool upon the hand attachment element.

A primary objective of the present invention is to provide a universal holder device having advantages not taught by the prior art.

Another objective is to provide a universal holder device that can be adapted to hold almost any tool securely on the back of the user's hand.

A further objective is to provide a universal holder device that adjustably holds the tool so that the user can readily adjust the orientation of the tool for greatest ease of use of the tool.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 2:
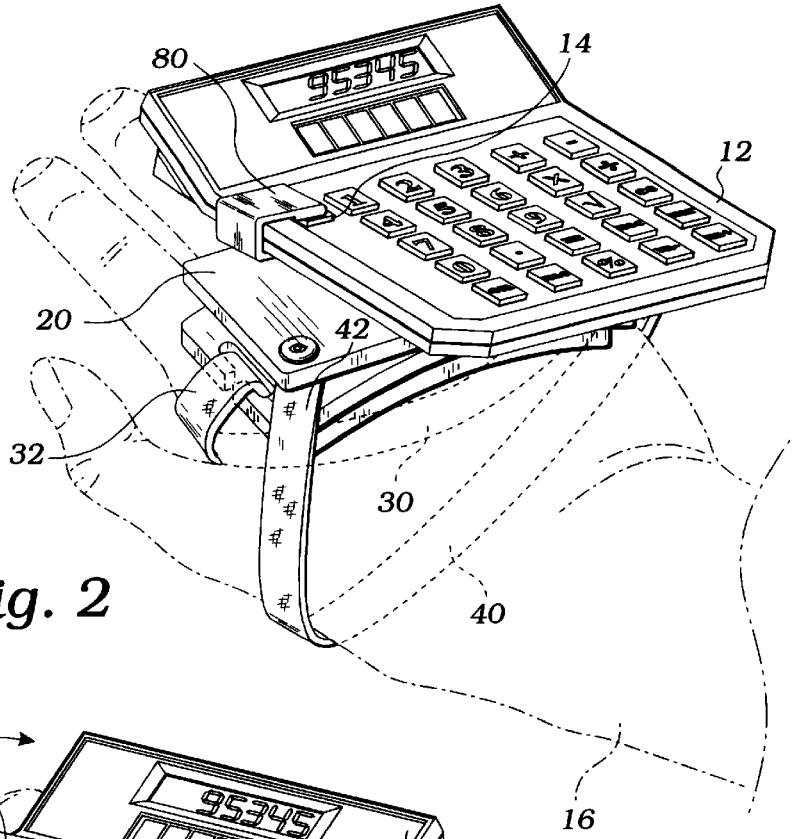
FIG. 2 is a perspective view thereof illustrating how a calculator mounted upon a user's hand using the invention.
Figure 3:
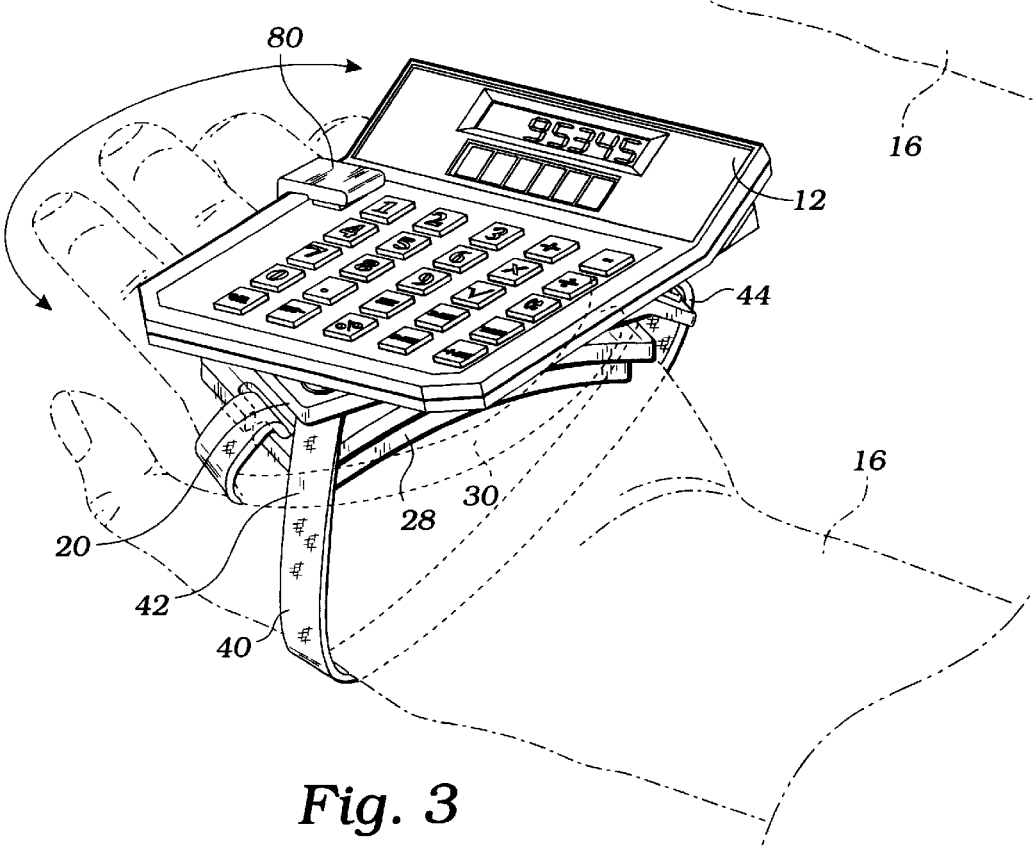
FIG. 3 is a perspective view thereof illustrating how the calculator can be rotated upon the invention with respect to the user's hand.
Figure 4:
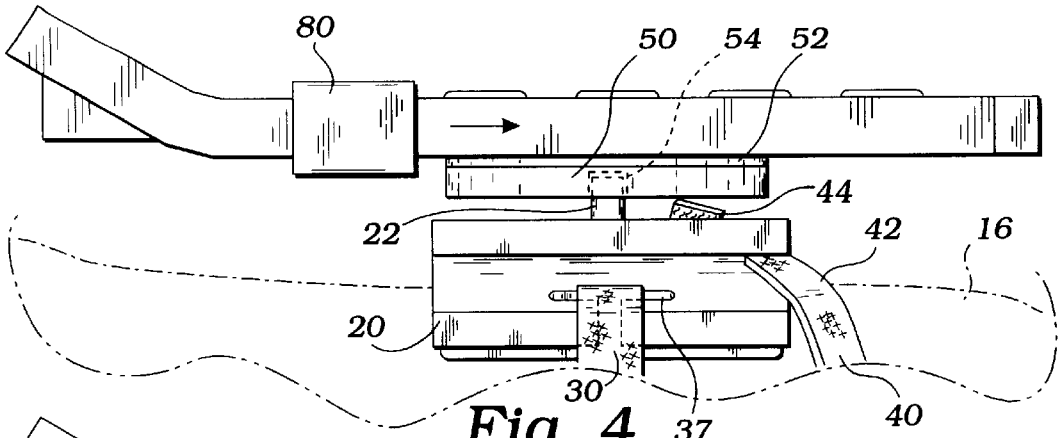
FIG. 4 is a side elevational view of the calculator mounted upon a tool attachment element which is frictionally attached to the hand attachment element.

The above described drawing figures illustrate the invention, a universal holder device 10 for mounting a tool 12 upon a user's hand 16. As shown in FIGS. 2–4, the universal holder device 10 includes a hand attachment element 20 and a tool attachment element 50. The hand attachment element 20 includes an attachment post 22. The tool attachment element 50 has an adhesive layer 52 for attaching the tool attachment element 50 to the tool 12. The tool attachment element 50 also includes a post receiving bore 54 that is shaped to receive the attachment post 22 to rotatably mount the tool 12 upon the hand attachment element 20.

As shown in FIGS. 1–6, the hand attachment element 20 has a first edge 24, a second edge 26. The attachment post 22 extends upwardly from between the first and second edges 24 and 26. The hand attachment element 20 is preferably a generally rectangular molded plastic base having a padded layer 28 shaped to comfortably rest on the back of the user's hand 16. The attachment post 22 is preferably a cylindrical post that is integral with the rest of the hand attachment element 20. The attachment post 22 is preferably constructed of nylon or similar material that can frictionally engage the post receiving bore 54 without locking up and becoming welded by friction within the post receiving bore 54.

The hand attachment element 20 includes a first attachment strap 30 and a second attachment strap 40 that cooperate to removably attach the hand attachment element 20 to the user's hand 16. The first attachment strap 30 having a first end 32, a second end 34, and an elastic strap body 36. The first end 32 is attached adjacent the first edge 24 and the second end 34 is attached adjacent to the second edge 26. In the preferred embodiment, the first attachment strap 30 is a loop of flexible and elastic material that that is inserted into a slot 37 located at both the first end 32 and the second end 34. The first attachment strap 30 is inserted into each of the slots 37 through an insertion aperture 38 located in each of the slots 37, thereby stretching the first attachment strap 30 across the hand attachment element 20. In use, the first attachment strap 30 and the hand attachment element 20, together, form a loop through which the fingers of the user's hand 16 can be inserted such that the elasticity of the first attachment strap 30 tends to secure the hand attachment element 20 to the back of the user's hand 16. While this structure is currently preferred, the attachment mechanism is not important to the structure of the invention, and those skilled in the art will recognize that many attachment mechanisms can be used, including rivets, adhesives, hooks and loops, and other attachment mechanisms.

The second attachment strap 40 has a fixed end 42 and a detachable end 44. As with the first attachment strap 30, the second attachment strap 40 is preferably constructed of a flexible, elastic material. The fixed end 42 is attached adjacent the first edge 24 with a rivet 43, an adhesive, a fastening pin, or similar attachment. The second attachment strap 40 further includes a means for removably engaging 46 the detachable end 44 adjacent to the second edge 26. In the preferred embodiment, the means for removably engaging 46 is a hooks and loops fastener such as VELCRO® or similar fastening device or material. In use, the second attachment strap 40 is wrapped around the user's hand 16, around the wrist, and secured using the means for removably engaging 46 the detachable end 44 adjacent to the second edge 26, thereby locking the hand attachment element 20 onto the user's hand 16.

As shown in FIGS. 1 and 4–6, the tool attachment element 50 has an adhesive layer 52 and a post receiving bore 54. The tool attachment element 50 is preferably a plastic disk approximately 4 cm in diameter and 0.5 cm thick. The adhesive layer 52 includes a powerful adhesive such as double sided tape that allows the tool attachment element 50 to be securely attached to the tool 12. The post receiving bore 54 is shaped to frictionally engage the attachment post 22, thereby removably engaging the hand attachment element 20 to the tool attachment element 50.

In use, the tool attachment element 50 is attached to the tool 12 using the adhesive layer 52. While the tool 12 is preferably a calculator, the system is adapted to be used on almost any device that would be easier to use if attached to the back of the user's hand 16, including various writing pads, electronic measuring devices, electronic components, computer keyboards, and other tools. Many useful tools can be incorporated into the system through the use of several tool attachment elements 50, each of the tool attachment elements 50 being attached to a different tool. The user simply places the hand attachment element 20 onto the user's hand 16, as described above, and removably engages the tool attachment element 50 to the hand attachment element 20 by inserting the attachment post 22 into the post receiving bore 54. As shown in FIGS. 2 and 3, the attachment post 22 allows the tool 12 to be rotated with respect to the user's hand 16 to the preferred position.

Figure 1:
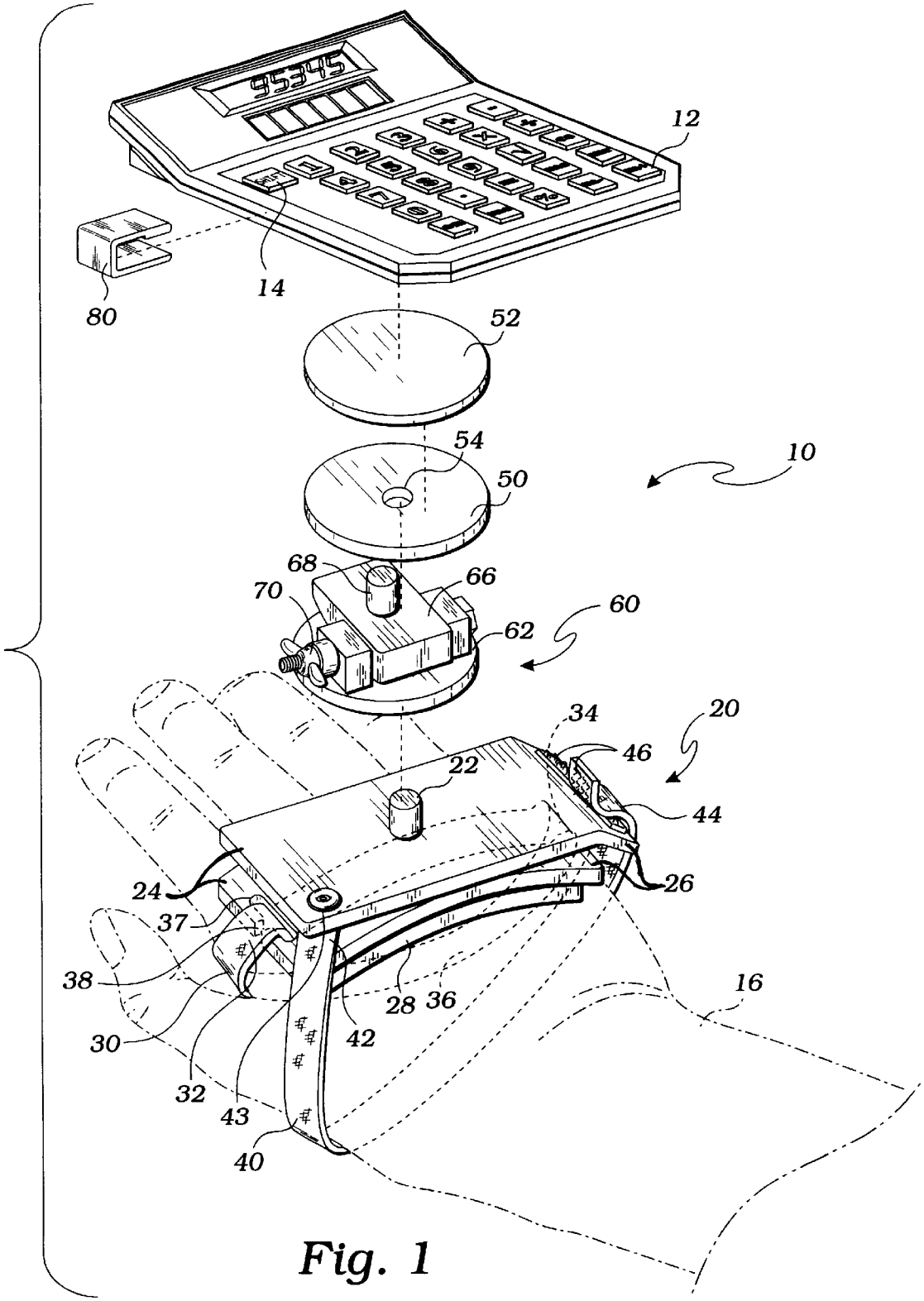
FIG. 1 is an exploded perspective view of the preferred embodiment of the present invention.
Figure 5:
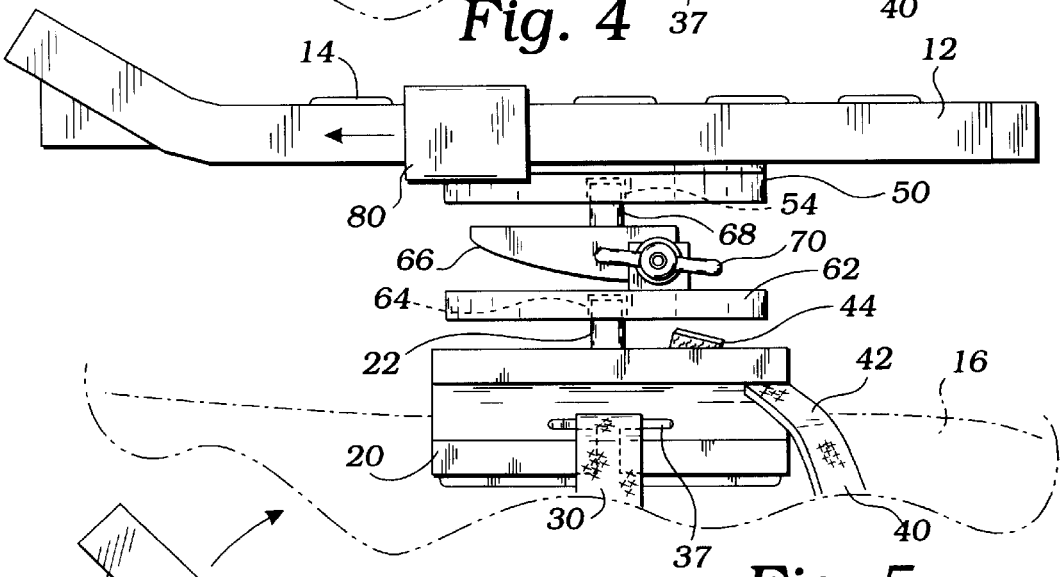
FIG. 5 is a side elevational view of the tool attachment element frictionally attached to the hand attachment element with first and second pivot elements.
Figure 6:
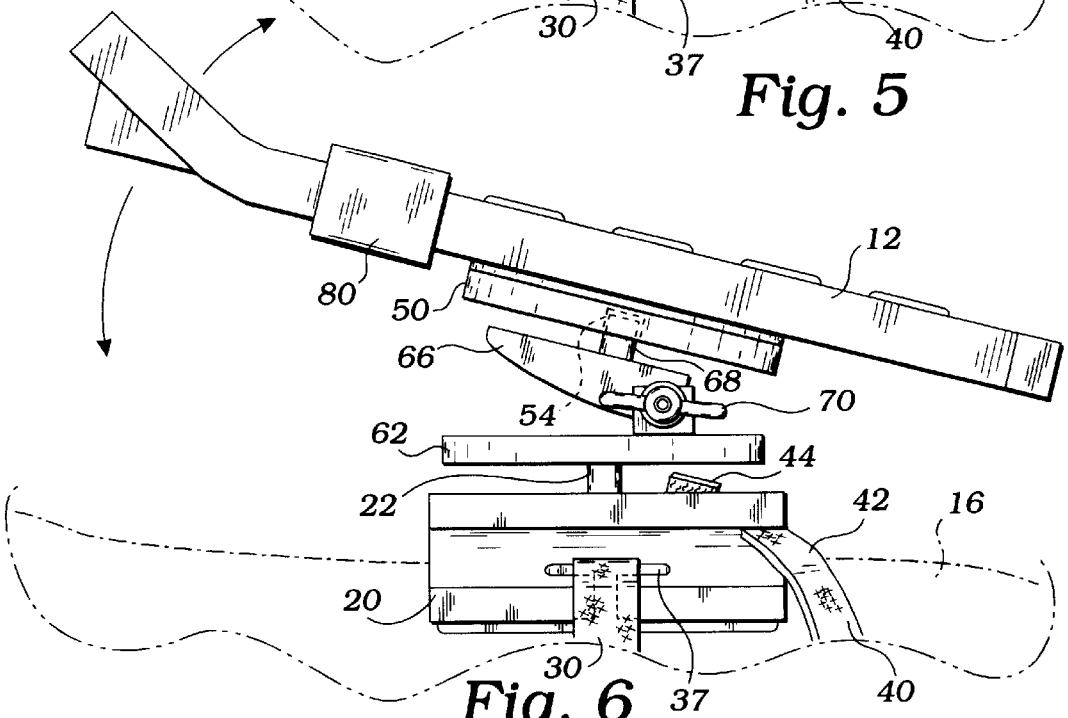
FIG. 6 is a side elevational view illustrating how the calculator pivots upon the first and second pivot elements.

In the preferred embodiment, as shown in FIGS. 1, 5, and 6, the universal holder device 10 further includes a means for pivotally attaching 60 the attachment post 22 to the post receiving bore 54. The means for pivotally attaching 60 the attachment post 22 to the post receiving bore 54 preferably includes a first pivot element 62 pivotally attached to a second pivot element 66 with a pivot screw 70 or similar mechanism. The first pivot element 62 has a pivot bore 64, and the second pivot element 66 has a pivot post 68. The pivot bore 64 is shaped to frictionally engage the attachment post 22. The pivot post 68 is shaped to frictionally engage the post receiving bore 54. By including the first and second pivot elements 62 and 66 between the hand and tool attachment elements 20 and 50, the universal holder device 10 gains the ability to pivot the tool 12 with respect the user's hand 16, as shown in FIGS. 5 and 6, thereby further increasing the comfort and versatility of the universal holder device 10.

As shown in FIGS. 1–6, the universal holder device 10 further includes a shift clip 80 constructed of resilient plastic. The shift clip 80 is generally U-shaped and designed to frictionally engage the calculator 12 adjacent a shift key 14. In use, the shift clip 80 is positioned over the shift key 14 such that the natural resilience of the shift clip 80 holds down the shift key 14. The shift clip 80 enables the user to use the shift key 14 of the calculator 12 even though he or she is operating the calculator 12 using one hand. By sliding the shift clip 80 up and down, as shown in FIGS. 4 and 5, the user can engage and disengage the shift key 14, thereby facilitating full use of the calculator 12.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A universal holder device for mounting a tool upon a user's hand, the universal holder device comprising:

a hand attachment element having a first edge, a second edge, and an attachment post extending upwardly from between the first and second edges;

a first attachment strap having a first end, a second end, and a strap body, the first end being attached adjacent the first edge and the second end being attached adjacent to the second edge;

a second attachment strap having a fixed end and a detachable end, the fixed end being attached adjacent the first edge;

a means for removably engaging the detachable end adjacent to the second edge; and a tool attachment element having an adhesive layer and a post receiving bore, the post receiving bore being shaped to frictionally engage the attachment post, thereby removably engaging the hand attachment element to the tool attachment element.

2. The universal holder device of claim 1 further comprising a means for pivotally attaching the attachment post to the post receiving bore.

3. The universal holder device of claim 2 wherein the means for pivotally attaching the attachment post to the post receiving bore includes a first pivot element pivotally attached to a second pivot element, the first pivot element having a pivot bore, the second pivot element having a pivot post, the pivot bore being shaped to frictionally engage the attachment post, the pivot post being shaped to frictionally engage the post receiving bore.

4. A universal holder device for mounting a tool upon a user's hand, the universal holder device comprising:

a hand attachment element having a first edge, a second edge, and an attachment post extending upwardly from between the first and second edges;

a first attachment strap having a first end, a second end, and a strap body, the first end being attached adjacent the first edge and the second end being attached adjacent to the second edge;

a second attachment strap having a fixed end and a detachable end, the fixed end being attached adjacent the first edge;

a means for removably engaging the detachable end adjacent to the second edge;

a tool attachment element having an adhesive layer and a post receiving bore; and a first pivot element pivotally attached to a second pivot element, the first pivot element having a pivot bore, the second pivot element having a pivot post, the pivot bore being shaped to frictionally engage the attachment post, the pivot post being shaped to frictionally engage the post receiving bore.

5. The universal holder device of claim 4 wherein the tool is a calculator having a shift key, and wherein the universal holder device further includes a shift clip shaped to frictionally clip onto the calculator over and adjacent to the shift key such that the natural resilience of the shift clip will depress the shift key when the shift clip is moved to cover the shift key.

* * * * *